United States Patent [19]

Pigalev et al.

[11] Patent Number: 4,485,615

[45] Date of Patent: Dec. 4, 1984

[54] APPARATUS FOR PIECING YARN TO BROKEN END OF A FIBROUS STRAND IN A SPINNING MACHINE

[76] Inventors: Evgeny Y. Pigalev, 2 Moskovskaya ulitsa 29, kv. 26, Shuya; Juvenaly V. Pavlov, prospekt Textilschikov, 115, kv. 36; Alexandr S. Osipov, ulitsa Blagova, 21, kv. 17, both of Ivanovo; Vladimir L. Kulikov, ulitsa Dmitrieva, 17, Ivanovo, all of U.S.S.R.

[21] Appl. No.: 243,800

[22] Filed: Mar. 16, 1981

[51] Int. Cl.[3] ..... D01H 15/00

[52] U.S. Cl. ..... 57/261; 57/22; 57/263

[58] Field of Search ..... 57/22, 261, 262, 263

[56] References Cited

U.S. PATENT DOCUMENTS 3,626,440 12/1971 Harmon ..... 57/261
4,217,749 8/1980 Rohner et al. ..... 57/22 X
4,223,517 9/1980 Husges et al. ..... 57/261
4,246,744 1/1981 Matsui et al. ..... 57/22
4,314,437 2/1982 Rohner et al. ..... 57/22

*Primary Examiner*—John Petrakes
*Attorney, Agent, or Firm*—Fleit, Jacobson, Cohn & Price

[57] ABSTRACT

According to the method of the invention, the broken end of yarn and the end of the fibrous strand are caused to move simultaneously opposite to one another and, after the ends of yarn and the fibrous strand are brought close together, they are caused to deviate from the path of their initial movement and to run at a distance from one another in such a manner that during the untwisting of the end of yarn it engages the end of the fibrous strand to form a knot. In an apparatus for carrying out the method for piecing the end of yarn to the end of the fibrous strand, there is provided a device for gripping and transferring the end of yarn to the pulling device, which is formed by a pipe having an outlet pipe connected to a source of reduced air pressure.

7 Claims, 13 Drawing Figures

APPARATUS FOR PIECING YARN TO BROKEN END OF A FIBROUS STRAND IN A SPINNING MACHINE

The invention relates to spinning machines, and more particularly, to method and apparatus for piecing yarn to broken end of a fibrous strand in a spinning machine, which may be used in ring and traveler type spinning machines.

Known in the art is a widespread used method for piecing yarn to broken end of a fibrous strand, comprising finding the broken end of yarn on a bobbin, causing it to move toward the outlet pair of rolls of a pulling device applying to one of the rolls and piecing to the broken end of the fibrous strand.

According to another known method, the end of yarn is collected after breakage at the portion between the pulling device and a thread guide. Subsequently the gripped end of yarn is transferred toward the pulling device for piecing to the broken end of the fibrous strand.

By this method the broken end of yarn is transferred to the pulling device by a device performing a compound three-dimensional motion so that the end of yarn is caused to substantially deviate from the initial path of movement. Moreover, for piecing, the end of yarn is applied to the broken end of the fibrous strand in such a manner that their ends are directed opposite to one another. In this way the length of the applied ends is as great as 70 mm so that an enlarged portion is formed thus deteriorating the quality of yarn being produced. A substantial part of the broken end of the fibrous strand is rejected during the feeding of the broken end of yarn to the pulling device.

Apparatus for carrying out the prior art methods are of largely varying design (cf. Japanese patent No. 22290/1964, U.S. Pat. Nos. 3,149,451, 3,373,551, USSR Inventor's Certificate Nos. 278486, 270546) and comprise a yarn sensor which is installed independently, a device for collecting the end of yarn and a device for transferring the end of yarn to the pulling device.

The device for transferring the end of yarn to the pulling device comprises a lever performing a compound three-dimensional motion and having a roller which applies the broken end of yarn to the roll of the pulling pair of rolls of the pulling device. Mechanical, pneumatic or hydraulic actuators are used for moving the lever which make the piecing apparatus complicated in structure, encumber the working zone of the spinning machine and make the operation of the machine more complicated.

In addition, the reliability of piecing using such apparatus is rather low. This is mainly explained by the fact that a guide of the pulling device reciprocates during operation of the machine to cause the feed product (broken end) to move over the entire length of the roll of the outlet pair of rolls. Therefore, with the width of the broken end of 2 mm and yarn diameter 1 mm it is very unlikely that the end of yarn can be fed by the roller to the place of outlet of the broken end of the fibrous strand, and the misalignment of the end of yarn applied to the roll with the place of outlet of the broken end of the fibrous strand hampers the connection thereof with the broken end of the fibrous strand, so that the piecing cannot be effected.

A plate with an aperture into which the broken end of yarn is caused to enter is used for collecting the end of yarn (cf. USSR Inventor's Certificate Nos. 278486, 270546). The plate, however, lowers the reliability of the apparatus since the broken end of yarn not always enters the plate aperture.

To carry out the method for piecing yarn to broken end of a fibrous strand, comprising collecting the end of yarn on a bobbin and guiding it to a traveller and thread guide, the use is made of apparatus (cf. Japanese patent No. 22290/1964) having mechanisms for performing such operations and comprising levers performing three-dimensional motion and driven mechanically or pneumatically. Complicated design of such mechanisms lowers the reliability of the piecing apparatus as a whole.

An object of the present invention is to provide a method and apparatus for piecing yarn to broken end of a fibrous strand in a spinning machine, wherein piecing operations and devices for carrying out such operations are so constructed as to effect the transfer of the end of yarn to broken end of the fibrous strand along the shortest path without compound three-dimensional motion. Another object of the present invention is to simplify the arrangement of the apparatus, improve its reliability and reduce the rejection of broken end of the fibrous strand.

These and other objects are accomplished by that in a method for piecing yarn to broken end of the fibrous strand in a spinning machine, comprising collecting the end of yarn upon breaking at the portion between a pulling device and a thread guide, causing it to move to the pulling device and bringing in contact with the broken end of the fibrous strand for piecing, according to the invention, the end of yarn is caused to move to the pulling device simultaneously with the feeding of broken end of the fibrous strand opposite thereto along a path coinciding with the path of movement of the yarn being twisted from the pulling device toward the thread guide, and after the end of yarn and the broken end of the fibrous strand are brought close to one another, they are caused to deviate from the path of their initial movement and to run in parallel with one another at a distance therebetween which is selected so as to provide for their engagement with one another during untwisting of the yarn.

The transfer of yarn simultaneously with the feeding of the broken end of the fibrous strand opposite thereto along the path coinciding with the path of movement of the yarn being twisted makes it possible to remedy breakage in tenths of a second and to prevent wastage of broken end of the fibrous strand. Deviation of the end of yarn and broken end of the fibrous strand from the path of their initial movement and their arrangement in the straightened form in parallel with one another enables the production of a new type of connecting knot with maximum strength and minimum length thereof (less than 5 mm).

According to the invention, the transfer of the end of yarn and the feeding of broken end of the fibrous strand opposite to one another, as well as their deviation from the initial path of their movement are effected by means of an air flow so as to dispense with complicated mechanisms. In addition, the air flows make it possible to straighten, parallelize and orient the end of yarn and the broken end of the fibrous strand opposite to one another. This preparation of the respective ends before piecing enables their mutual retrieval, improves reliability of piecing and quality of the knot.

In an apparatus for carrying out the method according to the invention, comprising, provided between a pulling device and a thread guide of a spinning machine, a device for engaging and transferring the end of yarn to the pulling device and a yarn breakage sensor operatively coupled to gripper members of the engaging device according to the invention; according to the present invention said device for engaging and transferring the end of yarn to the pulling device comprises a pipe having an outlet pipe connected to a source of reduced air pressure, the inlet opening of the pipe being arranged in the immediate vicinity of the pulling device and the outlet opening being arranged adjacent to the gripper elements which comprise a roll which is caused to rotate in the direction opposite to the yarn delivery and a pressure roller which are installed with a clearance therebetween, the pressure roller being installed to engage the drive roll and coupled to the yarn breakage sensor which is installed inside the pipe adjacent to the outlet pipe.

This arrangement of the device for engaging and transferring the end of yarn makes it possible to collect and return back the end of yarn during its movement immediately after the breakage so as to dispense with complicated mechanisms, that is to ensure the transfer of the end of yarn along the shortest possible path without complicated three-dimensional motions.

According to the invention, the outlet pipe is arranged on the pipe at a distance from the inlet opening thereof which is commensurable with the length of the fiber broken end of the fibrous strand so as to enlarge the range of applications of the apparatus for piecing and to use it in handling fiber of any length.

The invention is characterized by that at the portion where the pipe communicates with the outlet pipe there is provided a projection partially closing the outlet pipe. This facilitates the mutual retrieval of the end of yarn and the broken end of the fibrous strand, improves the conditions for bringing them close to one another and for joining them before piecing and the reliability of the apparatus in operation.

In accordance with one embodiment of the invention, the projection closes the outlet pipe on the side of the outlet opening of the pipe, coaxial grooves being provided in the projection and internally of the pipe so as to handle fiber of minimum length exhibiting high static charge capacity.

According to another embodiment, the projection closes the outlet pipe on the side of the inlet opening of the pipe and has a V-shaped groove, and a V-shaped groove is also provided at the portion where the pipe communicates with the outlet pipe so that the conditions for distribution, parallelization and orientation of the end of yarn and broken end of the fibrous strand during their mutual retrieval and movement toward one another are improved owing to an optimum distribution of opposite air streams.

The invention is characterized in that in case yarn breakage sensors having a probe freely bearing against the outgoing yarn are used, a recess is provided in the pipe body internally thereof opposite to the sensor probe, so that the arrangement of actuating mechanisms of the piecing apparatus is simplified and the reliability of the apparatus in operation is improved.

The invention is also characterized in that the outlet pipe has an annular groove in which is installed a turbine having blades directed toward the axis of turbine rotation, the ends of the blades overlapping one another so as to define a free space for accommodating therein the end of yarn and the broken end of the fibrous strand being connected to one another. This facility ensures the handling of fiber of any length and type, enlarges the range of applications and improves reliability of operation of the apparatus and quality of knot.

Therefore, the method and apparatus according to the invention enable the transfer of the end of yarn, on the one hand, and broken end of the fibrous strand, on the other hand, opposite to one another along a path close to the path of initial movement of yarn so as to dispense with the operations associated with compound paths of movement of yarn and a mechanism for that purpose, simplify the arrangement of the apparatus for eliminating yarn breakage to maximum extent and make the apparatus versatile, that is suitable for any kind of fiber. Moreover, the method and apparatus according to the invention enable the elimination of yarn breakage in tenths of a second, reduce the wastage of spinning fiber, eliminate winding of the broken end of the surface of the roll or roller of the outlet pair of rolls of the pulling device.

The invention will now be described by explaining in greater detail the method and apparatus for piecing yarn to the broken end of the fibrous strand in a spinning machine, according to the invention, with reference to the accompanying drawings, wherein:

FIG. 1 schematically shows the feeding of broken end of the fibrous strand and the end of yarn opposite to one another;

FIG. 2 schematically shows the deviation of the ends of yarn and the fibrous strand from the path of their movement shown in FIG. 1;

Figure 2:
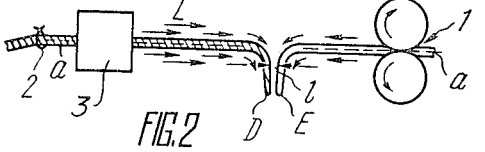
Figure 3:
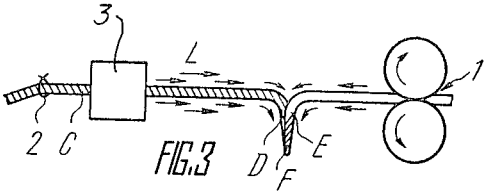
FIG. 3 shows the formation of a knot.
Figure 4:
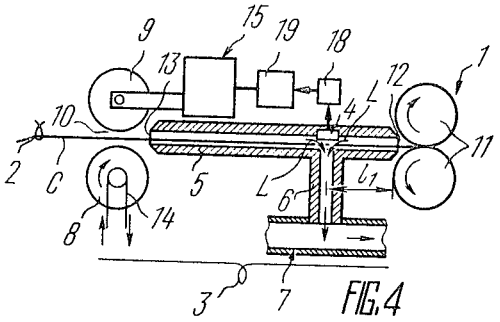
FIG. 4 is a diagrammatic view, partially in a longitudinal section, of an apparatus for piecing yarn.
Figure 5:
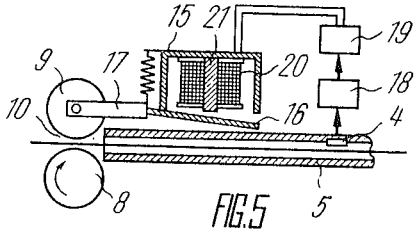
FIG. 5 is an embodiment of an actuating mechanism in the apparatus shown in FIG. 4.
Figure 7:
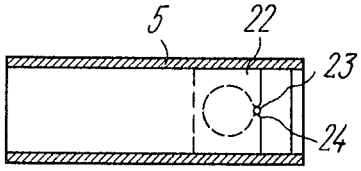
FIG. 7 is a sectional view taken along the line VII—VII in FIG. 6.

Method for piecing yarn to the broken end of a fibrous strand in a spinning machine consists in that, upon breakage of yarn C (FIG. 1), the end D thereof is collected by an engaging and collecting device 3 at the portion between a pulling device 1 and a thread guide 2. The broken end of yarn D is then caused to move to the pulling device 1 in the direction opposite to the movement of the twisted (outgoing) yarn C simultaneously with feeding of a broken end E of the fibrous strand opposite to one another along a path a—a coinciding with the path of the yarn C being twisted. As a result of the simultaneous movement of the end D of yarn and the broken end E of the fibrous strand opposite to one another they are brought closer together and straightened. After they are brought closer together, the ends E of the fibrous strand (FIG. 2) and of yarn are caused to deviate at right angles (90°) away from the path a—a of the initial movement thereof and to run in the straight form in parallel with one another at a distance 1 therebetween so as to ensure their engagement upon untwisting of the end D of yarn, whereby a knot F (FIG. 3) is formed, and the spinning process resumes. The transfer of the end D of yarn and feeding of the broken end E of the fibrous strand opposite to one another, as well as their deviation from the initial path a—a of their movement are effected by means of an air flow shown by arrows L in FIGS. 1, 2 and 3.

The method according to the invention is carried out by an apparatus shown in FIGS. 4 through 10, comprising, installed between the pulling device 1 (FIG. 4) and the thread guide 2 of a spinning machine, a device for engaging and transferring the end of yarn to the pulling device 1 and a sensor 4 for sensing the breakage of the yarn C.

The device 3 for engaging and transferring the end of yarn to the pulling device 1 comprises a pipe 5 having an outlet pipe 6 connected to a source 7 of reduced air pressure and gripper members in the form of a drive roll 8 and a pressure roller 9 installed with a clearance 10 therebetween. The pipe 5 is installed between rolls 11 of the outlet pair of rolls of the pulling device 1 and gripper members so that the inlet opening 12 of the pipe 5 is arranged in the immediate vicinity of the pulling device 1 opposite to the gripping line of the pair of rolls 11, and the outlet opening 13 is adjacent to the gripper members opposite to the nip clearance so that the longitudinal axis of the pipe 5 coincides with the path of the outgoing yarn C at the portion between the pulling device 1 and the thread guide 2.

The pressure roller 9 is mounted to engage the drive roll 8 and is operatively coupled to the yarn breakage sensor 4, the sensor 4 being installed inside the pipe 5 so as to rapidly react on the yarn breakage and to urge the pressure roller 9 against the drive roll 8 so as to grip (that is collect) the broken end of yarn owing to the rotation of the cylinder 8 and to feed it in the direction opposite to the direction of movement of the yarn C being twisted.

Rotation of the roll 8 may be caused by any known means, such as by means of a chain drive 14 from any motor (not shown).

Any actuating devices may be used for causing the pressure roller 9 to move, including an electromagnetic valve actuator 15 (FIG. 5) having an anchor 16 on which the pressure roller 9 is mounted by means of a mounting arm 17, the electromagnet 15 being electrically coupled to the yarn breakage sensor 4 via a time relay 18 and an amplifier 19 of any appropriate known type. When current is fed to a winding 20, the anchor 16 is urged against a yoke 21, and the pressure roller 9 is caused to move through the amount of the clearance 10 to bear against the drive roll 8.

The outlet pipe 6 (FIG. 4) is arranged on the pipe 5 at a distance $1_l$ from the inlet opening 12 thereof which corresponds with the length of broken end fiber.

As the source 7 of reduced air pressure, the use may be made of any known devices, such as a centrifugal fan so that two oppositely moving air flows are provided in the pipe 5 which combine to form a single flow at the portion where the pipe 5 communicates with the outlet pipe 6. The air flows constitute the means for transferring the broken end of yarn and the broken end of the fibrous strand opposite to one another and the means deviating these ends from the initial path of their movement at right angles corresponding to the angle at which the outlet pipe 6 and the pipe 5 are interconnected.

Figure 6:
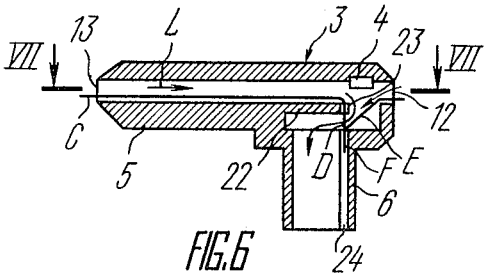
FIG. 6 is an embodiment of the pipe of the apparatus shown in FIG. 4.

As the portion where the pipe 5 communicates with the outlet pipe 6 there is provided a projection 22 (FIG. 6) partially closing the outlet pipe 6, the projection 22, as shown in FIG. 6, overlies the outlet pipe 6 on the side of the outlet opening 13 of the pipe and forming an extension of the inner surface of the pipe as shown in FIG. 6. As a result, the inlet of the outlet pipe 6 is displaced with respect to the axis of the outlet pipe 6 towards the inlet opening 12 of the pipe thus enabling the production of yarn with the broken end of the fibrous strand containing short fiber.

The projection 22 (FIGS. 6 and 7) is provided internally of the outlet pipe 6 with coaxial grooves 23 and 24, respectively, so that the end D of yarn and the broken end E of the fibrous strand might be caused to enter the outlet pipe 6 along the grooves 23 and 24 thereby providing favorable conditions for their engagement (twisting) to form a knot F.

Figure 8:
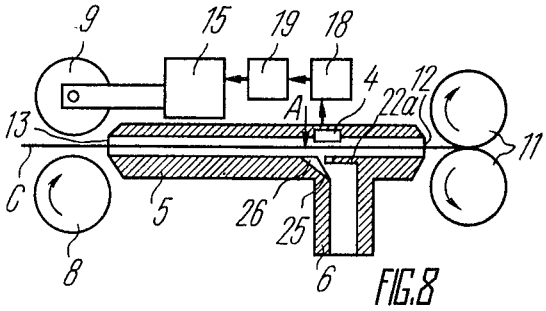
FIG. 8 is another embodiment of the pipe in the apparatus of FIG. 4.
Figure 9:
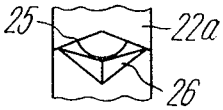
FIG. 9 is a view taken along arrow A in FIG. 8.

As shown in FIGS. 8 and 9, the projection 22*a* may be arranged in the pipe in such a manner as to close the outlet pipe 6 on the side of the inlet opening 12 of the pipe 5 and is provided with a V-shaped groove 25 (FIG. 9). A V-shaped groove 26 is also provided at the portion where the pipe 5 joins the outlet pipe 6 so as to improve the distribution of air flows in the pipe 5 by increasing the flow rate on the side of the outlet opening 13 of the pipe 5. This contributes to a better orientation of the yarn and thereby to improved stability and quality of operation of the apparatus.

Depending on the type of the yarn breakage sensor 4, the point at which it is installed in the pipe 5 may vary. Thus, in case the sensor 4 comprises a known photo sensor (FIGS. 4 through 8) electrically coupled to the actuating mechanism, it is installed inside the pipe 5 opposite to the entrance to the outlet pipe 6 as shown in FIGS. 4, 5, 6, 8.

Figure 10:
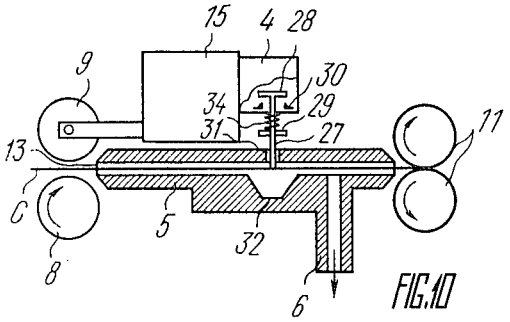
FIG. 10 is an embodiment of the apparatus for piecing yarn, partially in longitudinal section, having a sensor with a probe.
Figure 11:
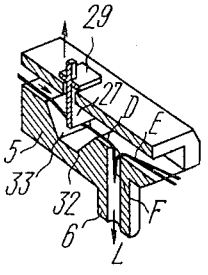
FIG. 11 is a perspective view showing a part of the pipe with the sensor probe at the moment of knot formation.

As shown in FIGS. 10 and 11, the yarn breakage sensor 4 has a probe 27 which has two spaced limiting abutments 28 and 29, the upper limiting abutment 28 (FIG. 10) being designed for cooperation with contacts 30 of the sensor 4 and the lower limiting abutment 29 being designed for contacting the outer surface of the pipe 5.

The probe 27 is inserted into the pipe 5 through a hole 31 and its end freely bears against the yarn C being twisted (FIG. 10) during normal operation of the machine. The hole 31 is provided in the pipe between the outlet opening 13 of the pipe 5 and the outlet pipe 6 closer to the outlet pipe as shown in FIG. 10, a recess 32 being provided in the body of the pipe 5 internally thereof opposite to the probe 27 for receiving the probe 27 (FIG. 11) upon breakage of yarn so that its limiting abutment 29 bears against the outer surface of the pipe 5. A space 33 is defined in this position between the bottom of the recess 32 and the lower extremety of the probe 27, through which the broken end D of yarn is fed by the air jet toward the pulling device for piecing to the broken end E of thread in the outlet pipe 6. To improve the reliability of the sensor 4, a spring 34 is provided on the probe 27 between the sensor body and the limiting abutment 29 (FIG. 10) facilitating a rapid lowering of the probe 27 and actuation of the sensor 4.

Figure 12:
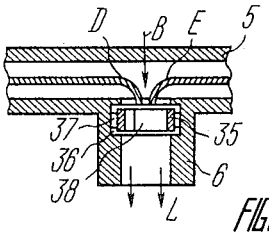
FIG. 12 is a partial longitudinal sectional view showing the arrangement of an auxiliary twisting device, such as a turbine, in the outlet pipe.
Figure 13:
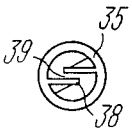
FIG. 13 is a view taken along arrow B in FIG. 12.

For forming a more reliable knot F, an auxiliary twisting device may be provided in the outlet pipe 6, such as a turbine 35 (FIG. 12). For that purpose, the outlet pipe 6 has an annular groove 36 in which are installed bearings 37 of the turbine 35, the blades 38 of the turbine (FIG. 13) being directed toward the rotary axis of the turbine. The ends of the blades 38 overlap one another as shown in FIG. 13 so as to define a free space therebetween for accommodation of the ends of yarn and the fibrous strand being interconnected. The turbine 35 is caused to rotate by the air flow provided in the outlet pipe, owing to the curved shape of the blades 38 of the turbine 35, or by means of any appropriate known drive (not shown).

The apparatus according to the invention functions in the following manner.

Figure 1:
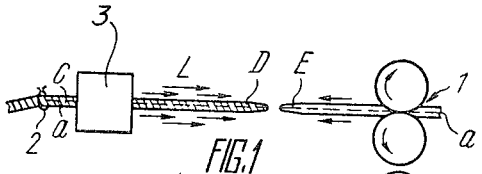

During the spinning, the thread which leaves the nip of the outlet pair of rolls 11 (FIG. 4) of the pulling device 1 is twisted during its movement toward the thread guide 2 into the yarn C by known means. During the twisting, the yarn C passes freely through the pipe 5 to the clearance 10 between the drive roll 8 and the pressure roller 9. The air flows L provided as a result of air suction through the outlet pipe 6 and passing through the pipe opposite to one another have no effect on the spinning process. During the thread twisting, the electric circuit coupling the sensor to the actuating mechanism is open. In case there is a breakage of yarn in the twisting zone, that is in the direct vicinity of the pulling device, the yarn breakage sensor 4 gives a signal in a known manner fed to the actuating mechanism (the electromagnet 15) which causes the displacement of the pressure roller 9 to bring it into engagement with the drive roll 8 and to grip the broken end D of yarn. The time during which the pressure roller 9 remains engaged with the drive roll 8 is determined by the velocity at which the broken end D of yarn is fed to the outlet pipe 6. As a result of rotation of the roll 8, the end D of yarn starts being fed in the direction opposite to the direction of movement of the yarn being twisted, that is toward the pulling device 1. Since the air flows L moving opposite to one another are permanently present in the pipe 5, the ends of the yarn and the fibrous strand engaged by these air flows (as shown in FIG. 1) start moving opposite to one another along the path a—a coinciding with the path of the yarn being twisted. During this movement the yarn and the fibrous strand are straightened and brought closer together and, as a result of the air jets passing through the outlet pipe 6, they change their direction to move through the outlet pipe 6 in the straight form, running parallel with one another at a sufficiently short distance 1 therebetween. Owing to the rotary motion of the broken end of yarn as a result of twisting, it is connected to the broken end of the fibrous strand, and a twisting occurs so that the knot F is formed.

After the piecing of yarn with the broken end of the fibrous strand in the outlet pipe 6, the pressure roller 9 is disengaged from the drive roll 8, and the yarn can again move owing to the rotation of a rotary drive of the spinning machine from the pulling device 1, the knot F being strengthened during the twisting, and the spinning process is completely restored.

In case the yarn is broken outside the pipe 5, the end of yarn is collected by a spinning operator on the bobbin in the known manner and is threaded into the clearance 10 between the drive roll 8 and the pressure roller 9, with subsequent lowering of the pressure roller 9 for engaging the drive roll 8.

Then the piecing process continues as described above.

The displacement of the inlet opening of the outlet pipe 6 toward the pulling device 1 (FIG. 6) provides for bringing the broken end D of yarn to the point closest possible to the pulling device 1, that is the portion at which the yarn is pieced to the broken end of the fibrous strand is arranged closer to the outlet pair of rolls of the pulling device thereby enabling the use of fibrous strands having short fiber.

In case the inlet opening of the outlet pipe 6 is displaced toward the outlet opening 13 of the pipe, the distribution of air flows in the pipe 5 is improved, and the apparatus becomes more reliable in operation.

What is claimed is:

1. An apparatus for piecing twisted yarn to a broken end of a fibrous strand in a spinning machine, said apparatus comprising: a pulling device; a thread guide; means positioned between said pulling device and said thread guide for gripping and transferring the end of the yarn; a yarn breakage sensor operatively coupled to the gripping and transferring means; said gripping and transferring means operative for gripping and transferring the end of the yarn toward the pulling device; a pipe having an outlet opening connected to a source of reduced air pressure and a first inlet opening arranged in immediate proximity to the pulling device and a second inlet opening adjacent to said gripping and transferring means; said gripping means comprising a driving roller which is caused to rotate in the direction opposite to the direction of yarn delivery and a driven pressure roller spaced from said driving roller to define a clearance therebetween; and means coupled to the yarn breakage sensor for causing said driven roller to move toward said driving roller.

2. An apparatus according to claim 1, wherein said outlet opening is provided on said pipe at a distance from the first inlet opening thereof which corresponds with the length of fiber of the broken end of the fibrous strand.

3. An apparatus according to claim 1, wherein a projection is provided at said outlet so as to partially close the outlet.

4. An apparatus according to claim 3, wherein said projection overlies the outlet, and coaxial grooves are provided in the projection and in the inner surface of the outlet.

5. An apparatus according to claim 3, wherein the projection overlies the outlet and has a V-shaped groove, and a V-shaped groove is also provided at the outlet.

6. An apparatus according to claim 3, wherein a recess is provided in the body of the pipe internally thereof opposite to the probe of the sensor.

7. An apparatus according to claim 6, wherein the outlet includes an annular groove, a turbine having blades directed toward the axis of turbine rotation, the ends of the blades overlapping one another to define a free space for accommodating therein the end of the yarn and the broken end of the fibrous strand being pieced, said turbine positioned in said annular groove.

* * * * *